United States Patent [19]

Vaccari

[11] 4,132,016

[45] Jan. 2, 1979

[54] SHOE, PARTICULARLY FOR GENERAL SPORTING ACTIVITIES AND TRAINING

[76] Inventor: Franco Vaccari, Paleoveneti, 3, Montebelluna (Province of Treviso), Italy

[21] Appl. No.: 844,780

[22] Filed: Oct. 25, 1977

[30] Foreign Application Priority Data

Apr. 8, 1977 [IT] Italy ..... 22330 A/77

[51] Int. Cl.[2] ..... A43B 5/00; A43B 3/10; A43B 23/07

[52] U.S. Cl. ..... 36/114; 36/10; 36/55

[58] Field of Search ..... 36/114, 10, 55, 9 R, 36/9 A, 11

[56] References Cited

U.S. PATENT DOCUMENTS

| | | | |
|---|---|---|---|
| 1,522,890 | 1/1925 | Krap | 36/10 |
| 2,537,156 | 1/1951 | Pennell | 36/9 |
| 3,858,337 | 1/1975 | Vogel | 36/55 |

*Primary Examiner*—Patrick D. Lawson

*Attorney, Agent, or Firm*—Guido Modiano; Albert Josif

[57] ABSTRACT

A shoe with a sole and an upper portion for general sporting activities and training, comprising a shell made in one piece from wear-resistant material, such as plastics, rubber and the like, and incorporating the sole and the upper portions of the shoe integral therewith. Inside the shell there is provided a liner having the form of a folded elongated strip internally overlying at least the sole portion, the heel and the instep portion of the shell and being bent at the toe portion and the heel portion to maintain continuity thereof and protect at least the arch, the toes, the plantar and heel portions of the wearer's foot.

10 Claims, 10 Drawing Figures

2
30
10
11
10a
10b
10c
16
12
13
40
15
17
14
4
5
2'

SHOE, PARTICULARLY FOR GENERAL SPORTING ACTIVITIES AND TRAINING

BACKGROUND OF THE INVENTION

This invention relates to a shoe for use preferably in general sporting activities and training.

Shoes for use for example in training and sporting activities are presently known comprising an upper constructed of fabric, hide or the like, which is joined to the sole by various different methods. There is thus an inevitable lack of structural continuity between the upper and sole, such as would give the shoe better anatomical characteristics.

A further disadvantage of the aforesaid known types is that each shoe is constructed by joining together several components, with obvious disadvantage from a productive point of view, as the production time and consequent cost become inevitably increased.

To obviate the said drawbacks, shoes have been introduced on to the market constructed in a single piece using a wear-resistant plastics material. Although these shoes are of very simple construction, they have the drawback of being uncomfortable for the user, as they do not offer sufficient comfort for the foot.

In order to obviate the said drawback, shoes have been constructed from a very soft plastics material, but although by virtue of their softness characteristics they offer a comfortable housing for the foot, they are inevitably of low mechanical strength which leads in a short time to considerable wear.

The present applicant has designed a shoe comprising an external shell of adequate mechanical strength constructed in a single piece from plastics material, and into which is inserted a soft inshoe which in practice gives considerable comfort to the user's foot.

Although this design has proved valid from a functional aspect, it is hardly convenient economically because the construction of a soft inshoe for inserting into the shell leads to cost increases which in many cases are unacceptable.

U.S. Pat. No. 3,325,919 discloses the use, in a footwear, of a protective liner made of supple material wrapping snugly the foot of the wearer and having a longitudinal slit at the insteps. This liner is similar to an inshoe or slipper.

U.S. Pat. No. 2,794,270 discloses the use, in a shoe, of a sock liner of flexible leather, which, in addition to the upper surface of the inner sole and the rear portion of the shoe upper, overlies also the inner surfaces of the sides of the shoe upper. This sock liner leaves the arch of the foot uncovered and consequently unprotected.

SUMMARY OF THE INVENTION

The object of the present invention is to obviate the aforesaid drawbacks by providing a shoe for general sporting activities which, although having optimum mechanical characteristics which ensure long life, at the same time offers considerable comfort to the user's foot.

A further object of the present invention is to provide a shoe formed from a very small number of component elements of extremely simple and rapid construction.

A further object of the present invention is to provide a shoe in which the component parts are assembled very rapidly and simply, without the aid of complicated or costly machinery.

A further object of the present invention is to provide a shoe which, because of its particular structural simplicity, is of extremely low production cost such as to ensure its wide acceptance by the public.

These and further objects, which will be more evident hereinafter, are attained by a shoe with a sole and an upper portion for general sporting activities and training, comprising a shell made in one piece from wear-resistant material, such as plastics, rubber and the like, and incorporating the sole and the upper portions of the shoe integral therewith, the upper portion having integral therewith an instep, a heel, a toe and two opposite lateral portions thereof and, inside said shell, a linear having the form of a folded elongated strip internally overlying at least the sole portion, the heel and the instep portion and being bent at the toe portion and the heel portion to maintain continuity thereof and protect at least the arch, the toes, the plantar and heel portions of the wearer's foot.

BRIEF DESCRIPTION OF THE DRAWINGS

Further characteristics and advantages will be more evident from the detailed description of a preferred but not exclusive embodiment of a shoe,particularly for general sporting activities and training, shown by way of non-limiting example in the accompanying drawings in which.

DESCRIPTION OF THE PREFERRED EMBODIMENTS

Figure 4:
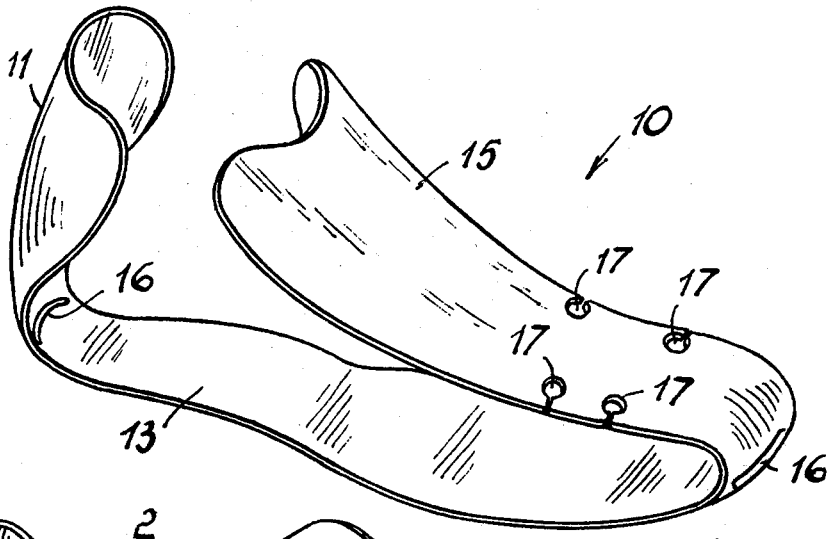
FIG. 4 is a diagrammatic view of the lining strip bent as if inside the shell.
Figure 2:
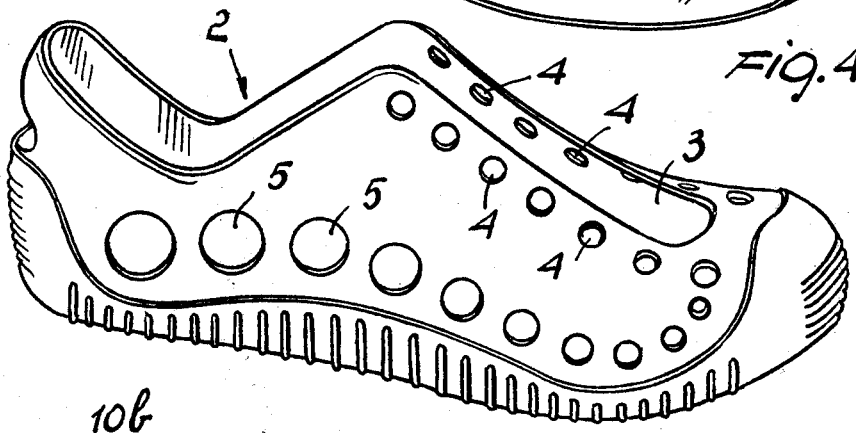
FIG. 2 is a perspective view of the shoe shell.
Figure 1:
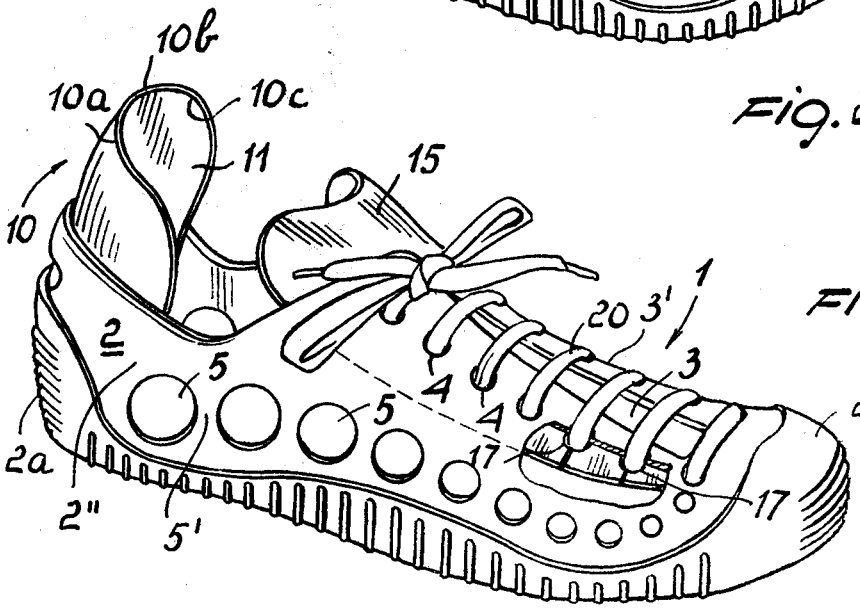
FIG. 1 is a partially cut-away perspective diagrammatic view of the shoe according to the invention.

With reference to said figures, the shoe according to the invention, indicated overall by the reference numeral 1, comprises a shell 2 constructed in one piece from soft wear-resistant plastics material, generally polyurethane or thermoplastic rubber, or another material of like characteristics.

Said shell 2 comprises integral therewith a sole portion 2' and an upper portion 2''. The upper portion 2'' comprises an instep portion 3'', a heel portion **2*a*, a toe portion 2*b* and two opposite lateral portions or sides 5'**.

Said shell 2 comprises, in the upper front region of the foot, i.e. at the instep 3', an incision 3 extending longitudinally to the shell 2 and comprising laterally two rows of holes 4 on either side. Reinforcing eyelets may be provided on said holes 4. In the sides 5' of the shell 2 there are provided generally circular apertures 5 the purpose of which is to facilitate perspiration of the foot and give the shell greater lightness together with better adaptability to the foot.

Inside the shell 2 is placed a liner or lining consisting of an elongated strip indicated overall by 10 and comprising preferably a layer of polyurethane **10*a* or like material, an intermediate layer of expanded polyurethane 10***b* or like material and a layer of velvet fabric 10*c* disposed on the inside, i.e. towards the user's foot.

Figures 3, 5, 6:
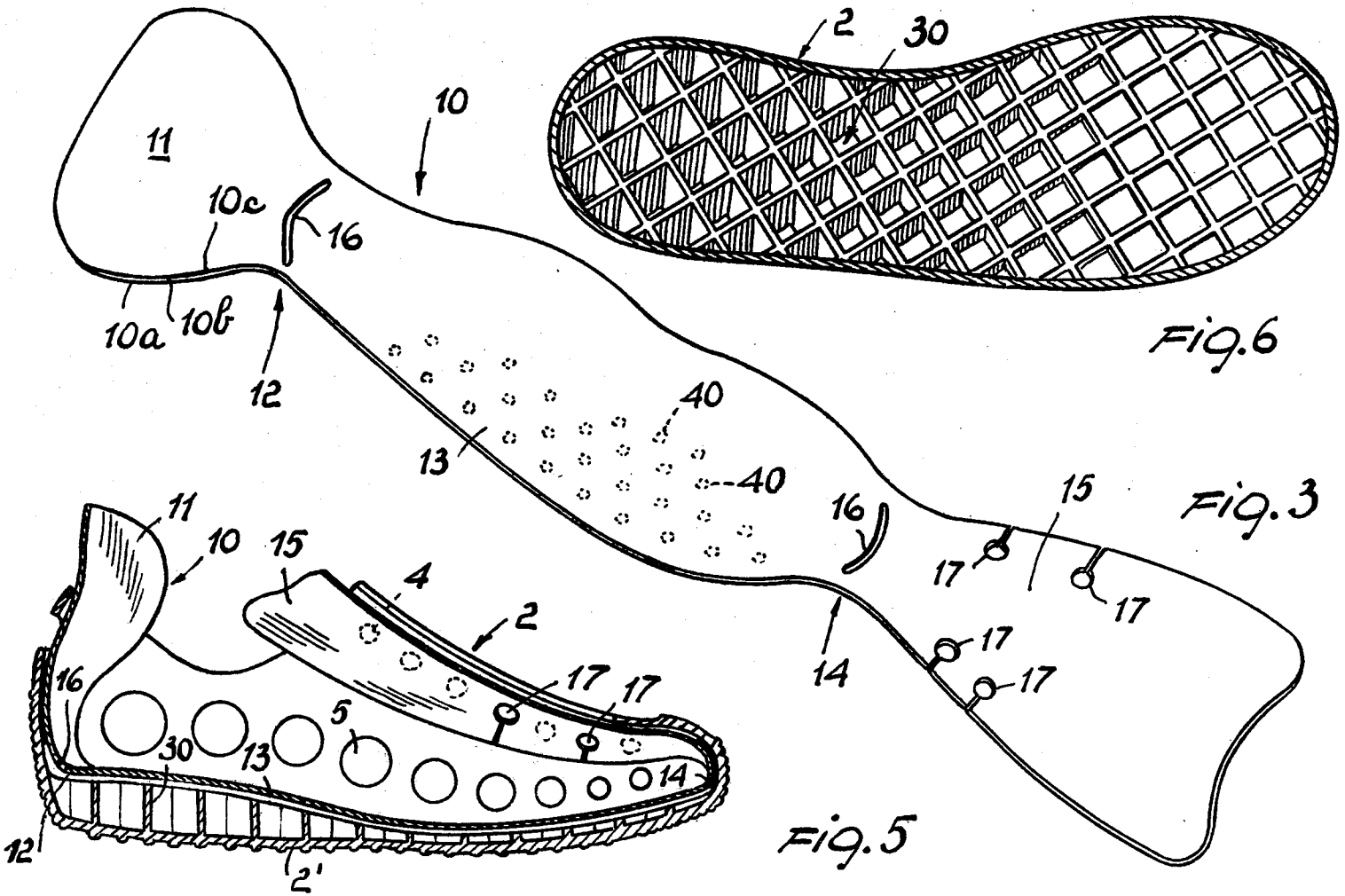
FIG. 3 shows the lining strip when extended.
FIG. 5 shows the shoe according to the invention with the shell in longitudinal section.
FIG. 6 is a diagrammatic view of the interior of the plantar region of the shell.

The lining strip, as shown in FIG. 3, is formed by punching, i.e. in practice it consists of an element originally of flat configuration, which considerably facilitates its construction and constitutes an important characteristic of the invention.

The strip 10 comprises an enlarged rear end 11 which is connected via a rear constricted region 12, to a central part 13 which is connected at the front to an enlarged front end 15 via a front constricted region 14.

The constricted regions 12 and 14, which may comprise slots 16, constitute the folding regions for the longitudinal folding of the strip element 10, in the manner diagrammatically shown in FIG. 4, for its insertion and fitting into the shell 2. More precisely, the lining strip 10 is placed in the shell 2 such that its rear enlarged end 11 becomes disposed to correspond with the heel of the shell 2, the central part 13 becomes disposed to correspond with the plantar region or sole of the shell and its front enlarged end 15 becomes disposed to correspond with the said incision 3 at the instep.

It can thus be seen that the inner lining of the shell, obtained by the strip 10, is of very simple construction as there are no sewing or other assembly operations necessary, it being necessary only to bend the strip 10 back on itself to obtain a lining for the shell offering considerable comfort to the user's foot.

In addition, to facilitate positioning and the maintaining of the predetermined position of the lining strip 10 inside the shell 2, an adhesive material may be interposed in the region of the front enlarged end 11, to firmly maintain the strip 10 in position. An insertion button or rivet may be provided to engage in a rear slot 18 provided in the shell 2.

To more easily maintain the front enlarged end 15 in position, it comprises at its edges notched holes 17, which, when the strip element is placed inside the shell, become disposed at the holes 4 provided to the sides of the incision 3. In this manner, parts of the laces 20 used for closing the shell 2 may, by passing through the notched holes 17, be passed under the enlarged front end 15, so that this latter becomes firmly retained to constitute the front tongue of the shoe thus formed.

Internally in its plantar region, the shell 2 is of anatomical beehive structure, indicated by 30, which both increases strength and allows any stresses to be relieved. Moreover, the said anatomical beehive structure 30 creates on the inside of the base of the shell 2 a plurality of side-by-side cell elements which increase the foot's facility for perspiration.

Furthermore, the said lining strip, mounted such that the polyurethane layer 10*a* faces outwards and thus in contact with the inner walls of the shell 2, may comprise perforations 40 the purpose of which is again to increase the foot's facility for perspiration.

As stated heretofore, the described shoe has therefore the considerable advantage of being constructed with a wear-resistant plastics shell which comprises internally a soft lining enabling adequate comfort to be obtained for the user's foot.

The special characteristic of the invention is the construction of the said lining in an extremely simple manner and of very low cost. In this respect, the lining is constructed from one punched element of correspondingly simple and rapid formation, and is simply folded to embrace the user's foot in a longitudinal direction. By this means, all the sewing and assembly problems of component parts are completely obviated, in that the only arrangement used for maintaining the lining in position is, if required, the interposing of a layer of adhesive material at one end of the strip 10 and holding the front end of the strip 10 with the laces 20, which are usually provided in a shoe, so as to ensure that the lining remains firmly in position.

A further advantage of this type of lining is that when the lining becomes worn, it is simple for the user to replace it, to give a shoe which is still practically new as the shell is constructed of a material of high mechanical strength and very long life.

A further advantage of the described shoe is that the shoe is extremely light, this lightness being obtained by virtue both of the materials used, which are soft wear-resistant plastics materials, and the special technical arrangements, namely the apertures which both facilitate perspiration and make the shoe more adaptable and light on the user's foot.

A further considerable advantage is that as the shell is constructed in one piece, it may be given a truly anatomical configuration, so providing the foot with the necessary support.

The invention so conceived is susceptible to numerous modifications, all of which fall within the scope of the inventive concept.

Figure 8:
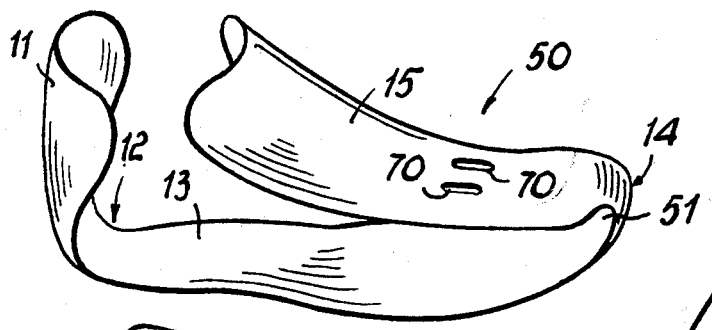
FIG. 8 shows the strip of FIG. 7 bent as if inside the shell.
Figure 7:
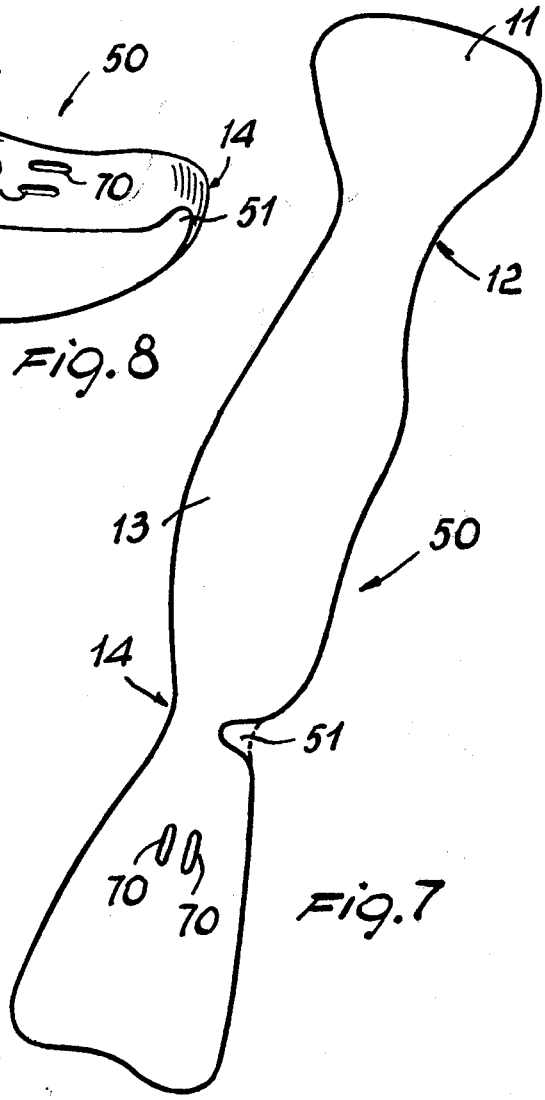
FIG. 7 shows another embodiment of the lining strip when extended.

Thus for example FIGS. 7 and 8 show a lining strip 50 similar to the strip 10 of FIG. 3, the difference being that at the front constricted region 14 there is a recess 51 to correspond substantially with the big toe, the purpose of which is to limit pressure on the big toe.

Figure 9:
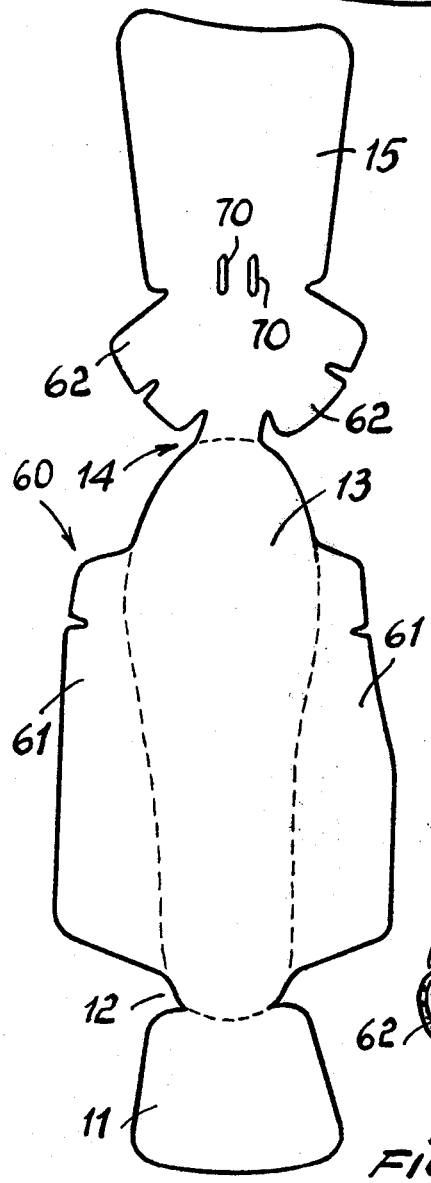
FIG. 9 shows a further embodiment of the lining strip when extended.
Figure 10:
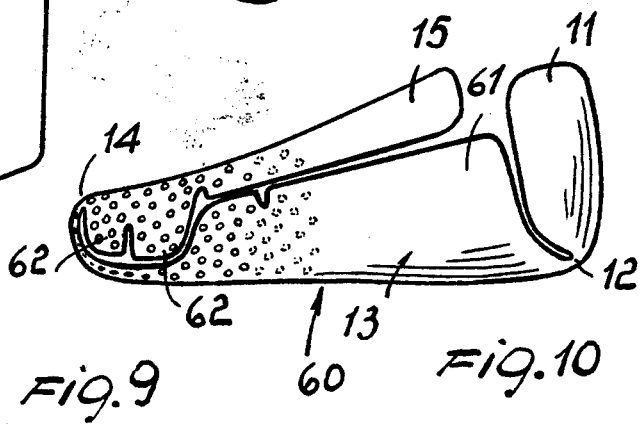
FIG. 10 shows the strip of FIG. 9 bent as if inside the shell.

Furthermore, FIGS. 9 and 10 show a lining strip 60 which comprises large lugs 61 to the sides of the central region 13, and fringes 61 on the enlarged front end 15 towards the central part 13. With this configuration, when the lining strip is folded into the shell 2 (FIG. 10), it practically completely embraces the foot.

Furthermore, as shown diagrammatically, in FIGS. 7 and 9 the notches 17 may be replaced by elongated slots 70 in which the laces 20 engage to keep the front enlarged end 15 of the lining strip in position.

All technical and constructional details may be modified within wide margins.

Although best results are obtained using soft wear-resistant plastics materials, the materials used may be varied at will, as may be the shapes and dimensions.

I claim:

1. A shoe with a sole and an upper portion for general sporting activities and training, comprising a shell made in one piece from wear-resistant material, such as plastics, rubber and the like, and incorporating the sole and the upper portions of the shoe integral therewith, the upper portion having integral therewith an instep, a heel, a toe and two opposite lateral portions thereof and, inside said shell, a liner having the form of a folded elongated strip internally overlying at least the sole portion, the heel and the instep portion and being bent at the toe portion and the heel portion to maintain continuity thereof and protect at least the arch, the toes, the plantar and heel portions of the wearer's foot.

2. A shoe, as claimed in claim 1, wherein said shell has a slit extending longitudinally along the insteps thereof and wherein said liner strip consists of a flat punched element foldable back on itself longitudinally.

3. A shoe, as claimed in claim 1, wherein said liner strip consists of a composite element the intermediate layer of which is soft expanded polyurethane.

4. A shoe, as claimed in claim 1, wherein said liner strip consists of a flat punched element with a rear enlarged end joined to said central part by way of a rear constricted region, said central part being joined frontwards to said front enlarged region via a front constricted region, said constricted regions defining the longitudinal folding regions of said punched element.

5. A shoe, as claimed in claim 1, wherein said liner strip comprises, in said front enlarged region, notched holes provided at the edges of said front enlarged region and arranged such that, when said liner strip is inside said shell, they correspond with holes provided to the sides of said incision, laces being engageable in said holes and in said notched holes to close said shell and keep said front enlarged end of said lining strip in position.

6. A shoe, as claimed in claim 1, wherein apertures are disposed on the sides of said shell.

7. A shoe, as claimed in claim 1, wherein a beehive configuration is provided on the inner plantar region of said shell to define a plurality of side-by-side cells.

8. A shoe, as claimed in claim 1, wherein a cut-away portion positioned substantially to correspond with the big toe is provided at said front constricted region of said lining strip.

9. A shoe, as claimed in claim 1, wherein said liner strip comprises enlarged lugs on said central part and fringes on said front enlarged end, so that when the strip is inside said shell it substantially embraces the whole foot.

10. A shoe, as claimed in claim 1, comprising longitudinal slots in said front enlarged end to engage with said laces.

* * * * *